United States Patent [19]

Hermes

[11] Patent Number: 4,566,645

[45] Date of Patent: Jan. 28, 1986

[54] APPARATUS FOR WINDING YARN

[75] Inventor: Julius Hermes, Martinsville, Va.

[73] Assignee: Martin Processing, Inc., Martinsville, Va.

[21] Appl. No.: 702,446

[22] Filed: Feb. 20, 1985

Related U.S. Application Data

[63] Continuation of Ser. No. 482,984, Apr. 7, 1983, abandoned.

[51] Int. Cl.[4] ..... B65H 54/20; B65H 59/00

[52] U.S. Cl. ..... 242/35.5 R; 242/18 DD; 242/45

[58] Field of Search ..... 242/35.5 R, 18 DD, 18 CS, 242/45

[56] References Cited

U.S. PATENT DOCUMENTS

| | | | |
|---|---|---|---|
| 1,357,470 | 11/1920 | Perry | 242/35.5 R |
| 1,941,724 | 1/1934 | Swanson | 242/18 DD |
| 2,888,215 | 5/1959 | Genovese, Sr. et al. | 242/35.5 R |
| 3,235,192 | 2/1966 | Scragg | 242/35.5 R |
| 3,441,231 | 4/1969 | Siegel | 242/18 DD X |
| 4,157,793 | 6/1979 | Lucia | 242/35.5 R |

FOREIGN PATENT DOCUMENTS

| | | | |
|---|---|---|---|
| 551896 | 1/1958 | Canada | 242/45 |

*Primary Examiner*—Stanley N. Gilreath

*Attorney, Agent, or Firm*—Stevens, Davis, Miller & Mosher

[57] ABSTRACT

An opener device for winding one or more strands of yarn, optionally used with a yarn heat setting apparatus. Strands which have been heat set and then cooled are wound onto a spool by one of a plurality of winding units in the opener device. The opener has a central drive means which moves a plurality of conveyor belts through the opener. These belts induce the rotation of a plurality of cam rollers and each of the cam rollers powers a pair of winding units. The winding units, each of which includes a grooved cam roller for feeding yarn onto a spool, are coupled to the cam roller by an eddy current coupling unit. The eddy current coupling unit imparts the rotation of the cam roller to the grooved cam roller by magnetism. The rotation of the grooved cam roller causes the spool to rotate and wind yarn due to friction. The eddy current coupling unit has two gap/separated drive plates, one with a magnetic layer and the other with a current carrying layer. By adjusting the size of this gap, thetorque imparted to the grooved cam roller by the cam roller can be varied and since the grooved cam roller has a fixed diameter, adjustment of the gap likewise varies the yarn tension. The tension/torque control mechanism permits yarn to be wound onto spools at a uniform tension which can be changed to wind different yarn types onto different size spools.

13 Claims, 7 Drawing Figures

APPARATUS FOR WINDING YARN

This application is a continuation of application Ser. No. 482,984, filed Apr. 7, 1983, now abandoned.

BACKGROUND OF THE INVENTION

The present invention relates to an apparatus for heat setting and winding one or more strands of yarn.

For many years, it has been desired to have the flexibility to heat set and wind any number of yarn strands simultaneously, wherein the quantity of yarn treated is solely dependent on the manufacturer's production requirements and not on the capacity of the equipment. In such a process, it is particularly desirable to be able to give the yarn strands a superior heat set and to adjust the tension at which each strand of yarn is wound so that it can be packaged with a predetermined tension. Such tension adjustment capability enables different types of yarn to be wound simultaneously.

It has also been desired to design a device having one drive means, which will simultaneously wind strands of yarn onto small spools and large spools in a satisfactory manner. It has been known to operate a plurality of individual winders to simultaneously wind a plurality of yarn strands. However, these individual winders are powered by separate drive means. In operations for simultaneously winding yarn onto large and small spools with one drive unit, difficulties have been encountered because when the large and small spools are rotated by the common drive unit, each of these spools will wind yarn at a different speed. More specifically, the larger spool will wind up a given length of yarn more rapidly than the smaller spool because of their different circumferences. Therefore, if the smaller spool is rotated so that it winds yarn at proper speeds, the yarn being wound by the larger spool may encounter high tension and snap. If the larger spool is rotated to wind its yarn at the proper speed, the yarn being wound by the smaller spool will become slack and may become entangled with equipment or other yarn strands. When using such devices, it is often necessary to rewind the yarn onto a spool with an individual winder to obtain the desired tension. It has therefore been desired to develop a winding unit which has the capability of simultaneously winding yarn onto different size spools without the above-mentioned problems.

SUMMARY OF THE INVENTION

Applicant has developed an improved apparatus for simultaneously winding a plurality of yarn strands. Although this apparatus is described for use in conjunction with a unit for heat setting yarn, the winding apparatus can be used with any device simultaneously treating a plurality of yarn ends such as, an apparatus for multiple end dyeing, texturizing, or mercerizing. Furthermore, while the present invention is particularly suitable for processing nylon or acrylic or polyester yarn, it can be used for processing any type of yarn, string, or other windable product.

In accordance with the present invention, one or more strands of yarn are drawn off of their respective spools and fed to a heat setting unit having a porous conveyor belt running horizontally through the length of the heat setting unit. The strands of yarn are dropped or disposed evenly across the width of the conveyor belt and then moved through the length of the heat setting unit in a period of time which varies depending on the type of yarn. In the heat setting unit, the strands of yarn are heated at temperatures of 280° F. to 420° F. by inducing flow of hot air downwardly through the yarn and the conveyor belt. Since the air flows vertically through the yarn, the yarn does not tumble but instead rests naturally upon the belt without being disturbed. Movement of the yarn while on the conveyor is further prevented by initially feeding the yarn to the heat setting unit at a speed faster than the speed of the conveyor so that the yarn slackens while on the conveyor. In the heat setting unit, the yarn initially undergoes bulking or fattening and then shrinks as the temperature of the yarn increases. This technique of heat setting has been found to induce a natural relaxation of the yarn which gives it superior properties. The heat setting time and temperature will vary slightly depending upon the type of yarn being treated, the denier, the twist, and whether the yarn is a continuous or non-continuous filament.

After the yarn is heat set, it leaves the heat setting unit in a slightly plastic state and is moved by the conveyor belt to a cooling section. In the cooling section, ambient air cools the yarn to a temperature of about 100° F. so that it is no longer in a plastic state. The cooling air is drawn vertically downward through the yarn and the conveyor to prevent the yarn from tumbling during the cooling operation. The yarn then accumulates in bins where it remains until it is drawn to an opener unit where each strand of yarn is wound onto a separate spool. By allowing a length of the yarn strands to accumulate in the bins after it is heat set and before it is wound onto spools, the heat setting unit and the opener unit are isolated from one another. Such isolation permits the heat setting unit to continue operating even if the opener unit is being repaired or vice versa. This arrangement is especially useful when yarn in the opener unit breaks or tangles.

The opener unit of the present invention is provided with a plurality of winding units to permit each of the accumulated heat set yarn strands to be wound onto individual spools. Each of the winding units is provided with one spool which is turned by a rotating, grooved cam roller on the winding unit as a thread of yarn is wound onto the spool. The opener unit has a central drive means which induces the movement of a plurality of drive belts within the opener unit. These drive belts induce the rotation of a plurality of cam rollers, wherein each cam roller drives a pair of winding units on opposite sides of the cam roller. The cam roller and the grooved cam roller are mounted on shafts and connected by an eddy current coupling unit. The eddy current coupling unit includes a drive plate with a current carrying layer, which is connected to the cam roller so that the rotation of the cam roller causes this drive plate to rotate, and another drive plate with a permanent magnet, which is coupled to the grooved cam roller. This coupling unit, which transfers the rotation of the cam roller to the grooved cam roller, has a gap between the current carrying layer and the permanent magnet of the drive plates. This gap can be adjusted to vary the magnetic flux density within the gap and thereby alter the amount of torque transferred by the cam roller to the grooved cam roller. The amount of torque applied to the grooved cam roller is therefore a function of the size of the gap between the magnetic and current carrying layers in the eddy current coupling unit and the speed of the central drive means. Since the grooved cam roller has a fixed diameter, the tension at which yarn is wound is likewise dependent on the size of the gap and the speed of the drive means. If yarn is fed to the winder unit at a rate slower than the windup speed created by the cam roller, or if a spool having a large circumference is used, slippage in the eddy current coupling unit occurs because the gap and drive means speed have been set so that the preselected grooved cam roller torque and yarn tension are not exceeded. When the preselected torque and tension have not been reached, the rotational speed of the grooved cam roller will increase until the preselected values of these parameters are achieved. In this manner, yarn is wound onto spools at a uniform tension and this tension can be adjusted to wind different types of yarn onto different size spools.

The winding mechanism of applicant's opener unit has a number of important benefits. By utilizing an eddy current coupling unit, no mechanical connection is required and consequently, no problems of friction or wear are encountered. Also, any number of the individual winding units in the opener can be operated simultaneously to wind different strands of yarn. Those winder units which are not being utilized can be disengaged by raising the spool so that it does not ride on the grooved cam roller.

DETAILED DESCRIPTION OF THE INVENTION

Figure 1:
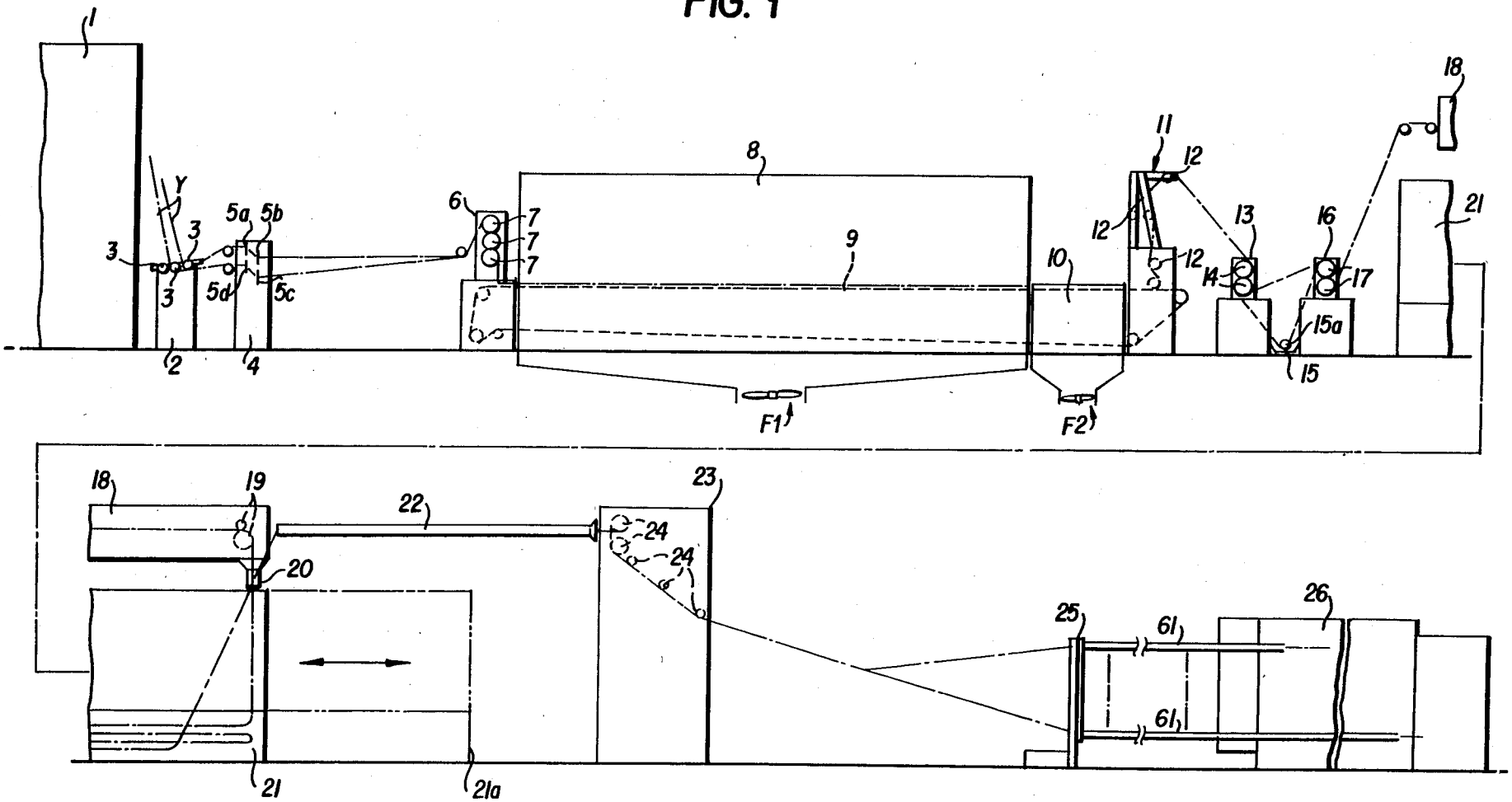
FIG. 1 shows a schematic illustration of an apparatus for heat setting and winding yarn.

FIG. 1 shows an apparatus for heat setting and winding a plurality of yarn threads, which are fed from as many as 1000–2000 spools in creel 1. From creel 1, strands of yarn Y move to a three-roller stand 2 having rollers 3 which take the threads of yarn and angle them towards the heat setting unit. From the three-roller stand 2, yarn Y travels to leaser 4 which has a plurality of perforated eye boards 5 through which yarn passes. Each of the eye boards 5*a*–5*d* oscillate vertically such that adjacent strands of yarn are vertically displaced in opposite directions. This displacement separates every other yarn line so that the tendency of adjacent threads of yarn to become entangled is reduced. Yarn Y is pulled off of creel 1 and through three-roller stand 2 and leaser 4 by pull roller stand 6 having driven pull rollers 7. Optionally, the yarn may be treated with a light spray of steam prior to entering pull roller stand 6 so that any static electricity on the yarn is eliminated. Pull roller stand 6 deposits the threads of yarn across the width of endless perforated conveyor belt 9 which carries the yarn horizontally into and through heat setting unit 8. In heat setting unit 8, hot air is drawn vertically downward through the yarn and the conveyor belt, by fan F1, to prevent tumbling of the yarn. The hot air is then returned to an air heating section by means not shown. In this heating section, air can be heated in any conventional manner, such as with indirect fired gas heaters, direct fired gas heaters, oil fired heaters, or electric heaters.

Conveyor belt 9 can be formed from Kevlar (a Registered Trademark of the E. I. DuPont de Nemours and Company, Inc., Wilmington, Del., USA), stainless steel, or any type of 40% open belt which will permit the passage of air and still be smooth enough to support yarn without entangling it. The speed at which conveyor 9 moves yarn through the heat setting unit 8 is a function of the length of the heat setting unit. The temperature of the heat setting unit and the period of time for which heat setting occurs varies depending on the type of yarn being treated.

The yarn leaves heat setting unit 8 in a slightly plastic state and is then moved by conveyor belt 9 to a cooling section 10. In cooling section 10, the yarn is cooled to a temperature of about 100° F. so that it is no longer in a plastic state. Cooling is achieved by drawing ambient air vertically downward through the yarn and the conveyor belt with fan F2. The heat ambient air from the cooling section is then exhausted from the cooling section.

The cooled yarn is raised off of conveyor belt 9 by yarn take-off guide unit 11 having guide rollers 12. The yarn then passes through pull roller stands 13 and 16 having driven pull rollers 14 and 17 respectively, which actually pull the yarn off of conveyor belt 9 and then straighten it so that it is in the form of a linear web. A finishing trough 15 is positioned between pull roller stands 13 and 16. When it is desired to apply a finish to the yarn before it is wound, the thread of yarn is pulled under roller 15*a* and through the finishing liquid in finishing trough 15. Various finishes can be applied depending on the properties which are to be imparted to the yarn. A common finish is an antistat which gives the yarn antistatic properties.

The straightened yarn is then drawn from pull roller stand 16 to folder 18 by a pair of driven folder rollers 19. Folder 18, which is positioned above bin 21, oscillates horizontally across the top of bin 21 so that the strands of yarn passing through folder outlet 20 are layered across the length of the bin. When bin 21 is full, a spare bin 21*a* can be moved under folder 18 to permit the layering of yarn to continue in this spare bin. Yarn at the base of bin 21 is drawn out of the bin and through guide tube 22 by head roller stand 23 having head rollers 24. There is no actual drive motor associated with head roller stand 23; the actual pulling force comes from downstream opener unit 26. From head roller stand 23, yarn passes through eye board 25 having separate holes to permit the passage of each individual strand of yarn. The holes in eye board 25 are spread apart as far as possible so that maximum separation of the individual yarn strands is achieved. Yarn then moves through tubes 61 to opener 26 where each strand is wound onto a separate spool. Initially, an end of yarn is rolled into a small ball, put in the upstream end of tube 61, and then blown with a stream of compressed air from an air hose to a winding unit in opener 26. At the winding unit, the yarn is attached to the spool onto which it is to be wound.

Figure 2:
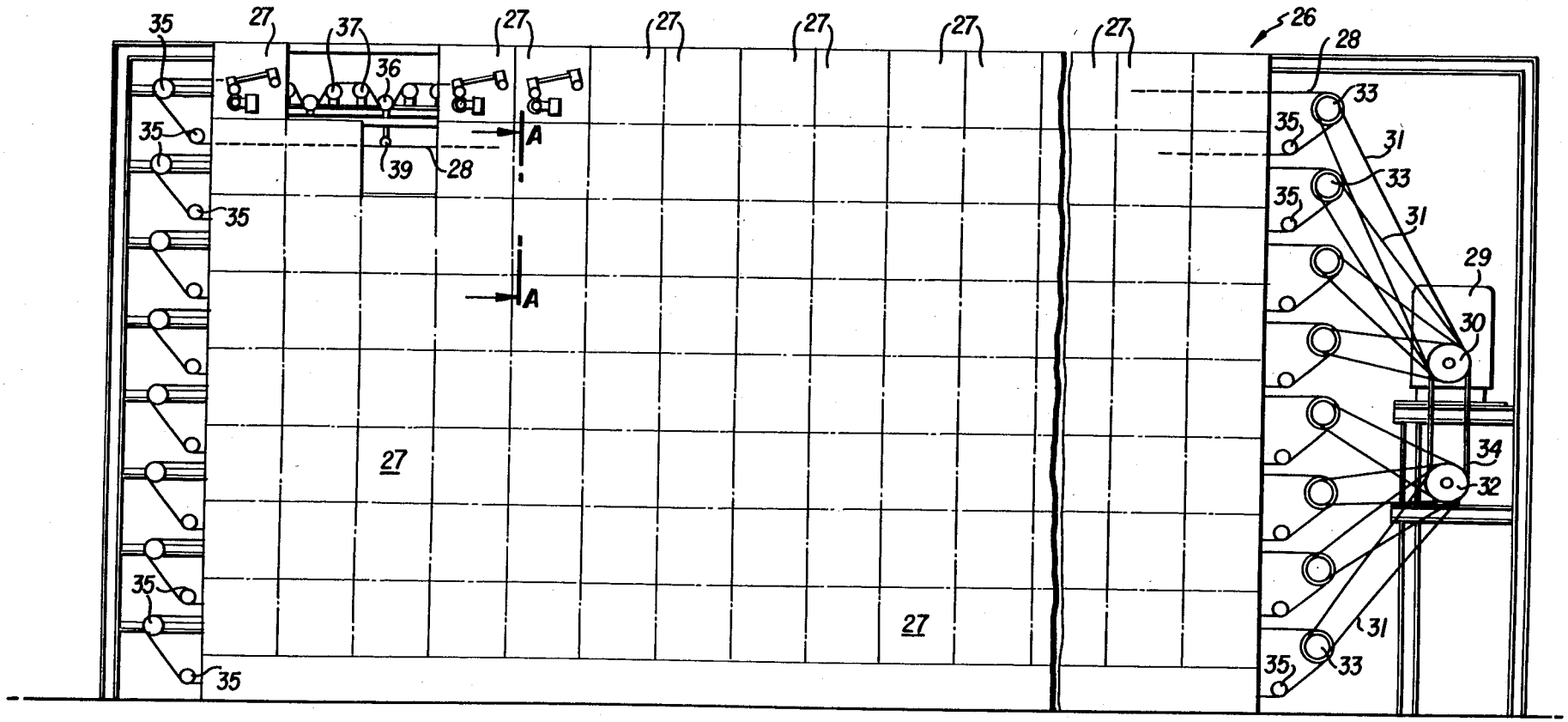
FIG. 2 is an enlarged side view of the opener unit.

FIG. 2 shows an enlarged and more detailed view of opener unit 26. Opener unit 26 is provided with a plurality of winding units 27 which are powered by drive belts 28 moving horizontally through the length of the opener unit. These drive belts 28 are powered by a DC motor or other drive means 29 which directly turns main drive pulley 30. Main drive pulley 30 is coupled to a secondary drive pulley 32 by secondary pulley drive belt 34. Main drive pulley 30 and secondary drive pulley 32 each power drive belts 31 which turn belt drive pulleys 33, which move drive belts 28 around pulleys 35.

In FIG. 2, the external portions of two individual winding units 27 are shown in an upper portion of opener unit 26. On the lefthand side of these two winding units, are two other adjacent winding units with their external portions removed to show the internally housed winding unit drive means. This winding unit drive means is shown in greater detail in FIG. 4 taken along line B—B in FIG. 3. In each winding unit, the upper run of belt 28 moves over idle rollers 37 and under cam roller 36 causing the rotation of idle rollers 37 and cam roller 36. The idle rollers 37 are supported by idle roller support beams 42 while the cam roller is supported by longitudinal support beam 40. The lower run of belt 28 passes beneath guide roller 39 which is connected to longitudinal support beam 40 by hanger 38.

Figure 3:
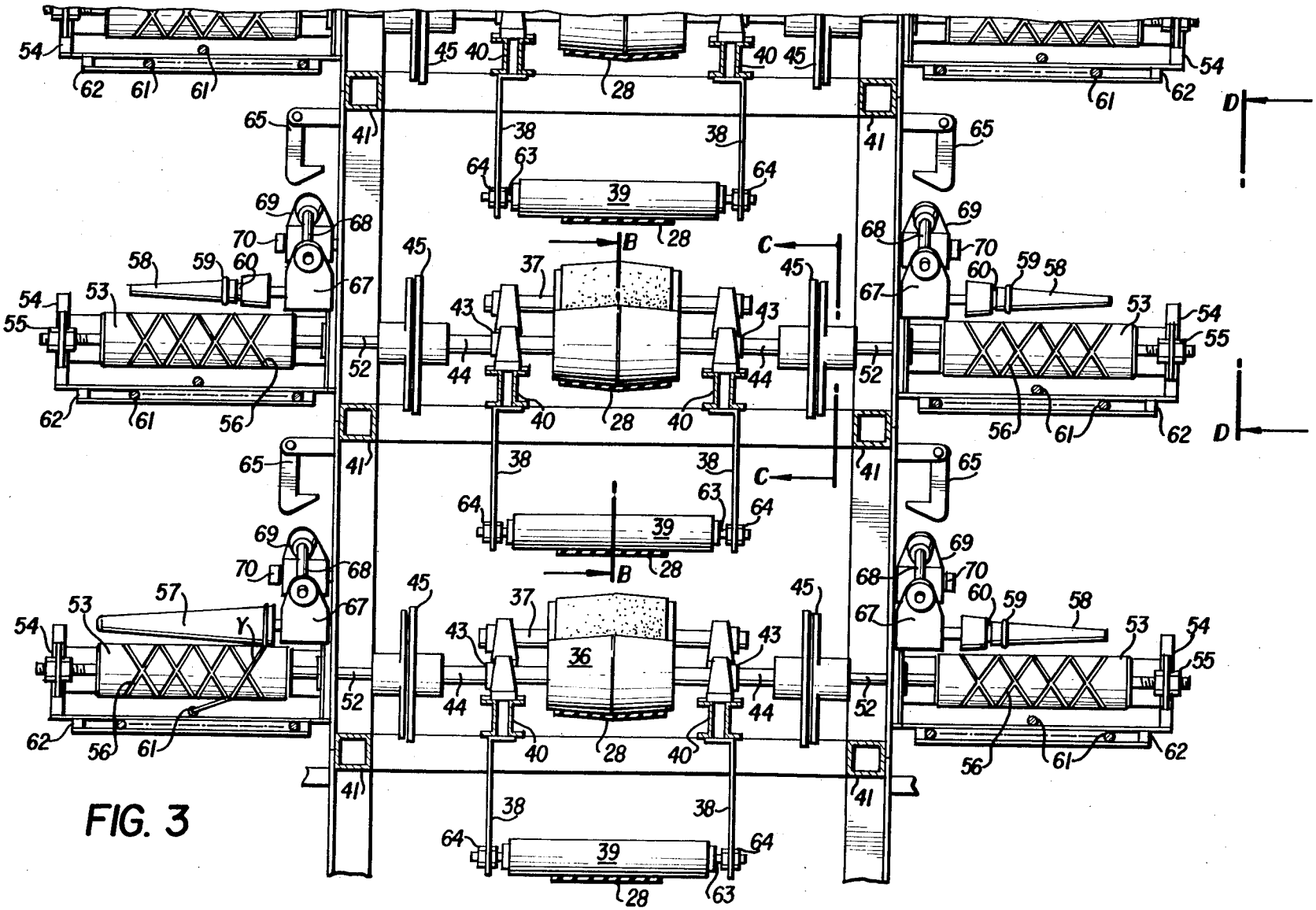
FIG. 3 is an enlarged cross-sectional view of the opener unit taken along line A—A in FIG. 2.
Figure 4:
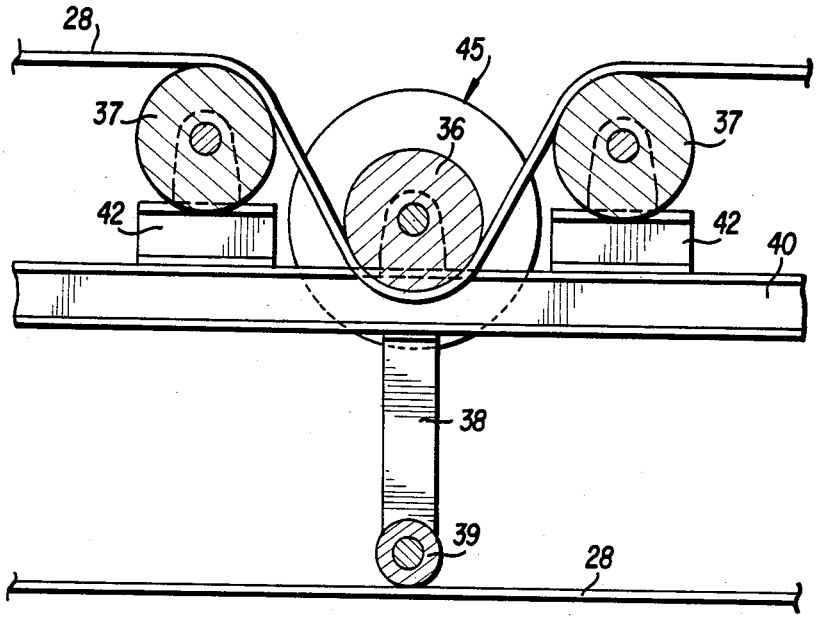
FIG. 4 is an enlarged cross-sectional view of the belt drive for each winder unit in the opener taken along line B—B of FIG. 3.

FIG. 3 shows a cross-sectional view of opener unit 26 taken along line A—A in FIG. 2. As indicated in the preceding paragraph, the upper run of belt 28 passes under cam roller 36 and as the belt moves, the cam roller 36 is rotated. A shaft 44 passes through bearing 43, which is mounted on longitudinal support beam 40, and couples cam roller 36 and eddy current coupling unit 45.

Figure 6:
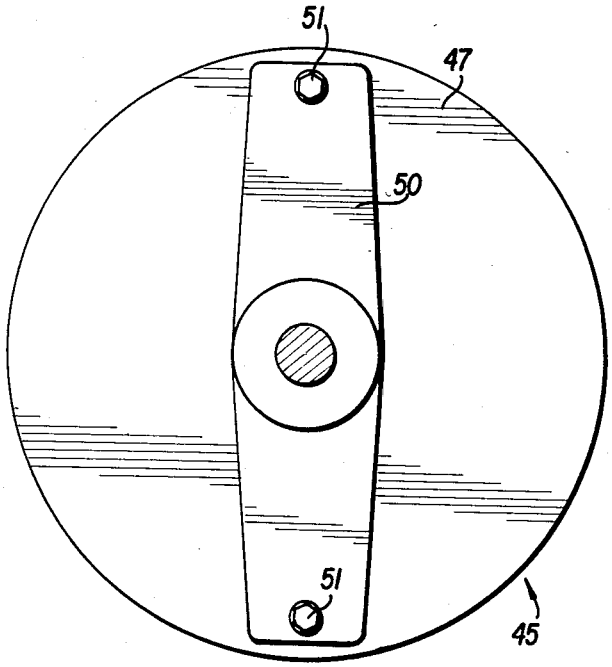
FIG. 6 is an enlarged side view of the eddy current coupling unit taken along line C—C of FIG. 3.
Figure 5:
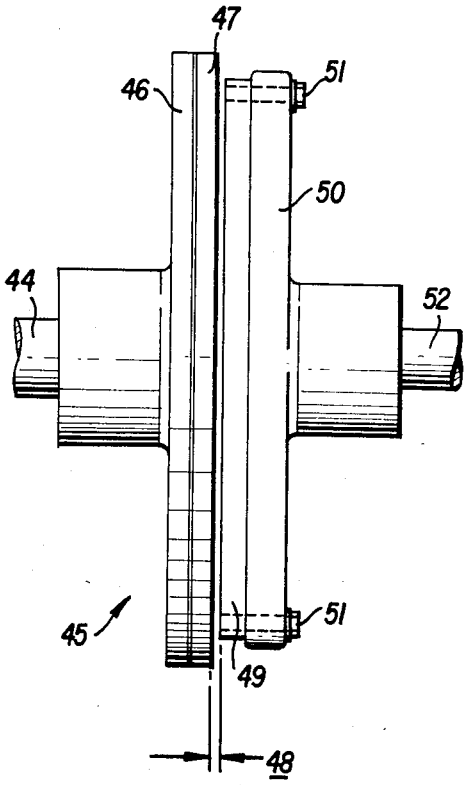
FIG. 5 is an enlarged side view of the eddy current coupling unit.

FIG. 5 shows an eddy current coupling unit 45 in greater detail. Shaft 44 is connected to drive plate 46 of the eddy current coupling unit and drive plate 46 is provided with a current carrying layer of aluminum or copper 47. Eddy current coupling unit 45 is also provided with another drive plate 50 which faces drive plate 46 and has a permanent magnet 49 attached to it with bolts 51. Plate 50 is also connected to shaft 52 which transfers the rotation of plate 50 to the spool winding unit. Current carrying layer 47 and magnet 49 define an air gap 48 between them. The size of air gap 48 is such that the rotation of plate 46 by shaft 44 creates a magnetic flux which turns plate 50 and shaft 52. FIG. 6 shows another view of the eddy current coupling unit taken along line C—C of FIG. 3.

In FIG. 3, shaft 52 is shown passing through side wall 72, cam roller 53, and cam support 54. A nut 55 is screwed onto the threaded end of shaft 52 adjacent to cam support 54. By turning nut 55, shaft 52 will move drive plate 50 of eddy coupling unit 45 towards or away from drive plate 46, respectively decreasing or increasing the size of air gap 48. As air gap 48 is increased in size, the magnetic flux imparted to plate 50 by the rotation of plate 46 decreases. The reduction in magnetic flux causes cam roller 36 to impart less torque to cam roller 53. Consequently, the amount of torque applied to cam roller 53 is a function of the size of air gap 48. Since cam roller 53 has a fixed diameter, the tension at which it winds yarn is likewise dependent on the size of air gap 48. Adjustment of nut 55 therefore permits adjustment of the torque applied to cam roller 53 and the tension at which yarn is wound. After nut 55 has been positioned so that a predetermined torque is applied to cam roller 53 and yarn is wound at a predetermined tension, slippage will occur between the drive plates 46 and 50 of eddy current coupling unit 45 if yarn is fed at a speed slower than the windup speed created by cam roller 36 or if a spool having a large circumference is used. This slippage results because air gap 48 has been set so that the preselected torque applied to cam roller 53 and the preselected tension with which yarn is wound are not exceeded. When the preselected torque and tension have not been reached, the rotational speed of the grooved cam roller will increase until the preselected values of these parameters are achieved. In accordance with this mode of operation, grooved cam roller 53 will reach the rotational speed of cam roller 36 when yarn is not being wound. When yarn is being wound, the rotational speed of grooved cam roller 53 is that speed which will deliver the preselected torque and impart the preselected tension. In this manner, yarn is wound onto spools at a uniform tension.

As shown in FIG. 3, spool 57 is mounted on spindle 58. Spool 57, as shown in the lower left of FIG. 3, has a conical shape and is known in the art as a shipping cone or tube. Other spool configurations, such as cylindrical spools, could, however, be utilized. An O-ring 59 is positioned in grooves 60 to hold the spool 57 in position when it is slipped over spindle 58. Spool 57 rides on cam roller 53 so that the rotation of cam roller 53 frictionally turns spool 57. Yarn, the end of which is attached to spool 57, passes under cam roller 53 and then between spool 57 and cam roller 53 in the helical groove path 56 of cam roller 53. As cam roller 53 turns, the yarn, riding in helical groove path 56, traverses the length of spool 57 and is evenly wound onto the rotating spool.

Figure 7:
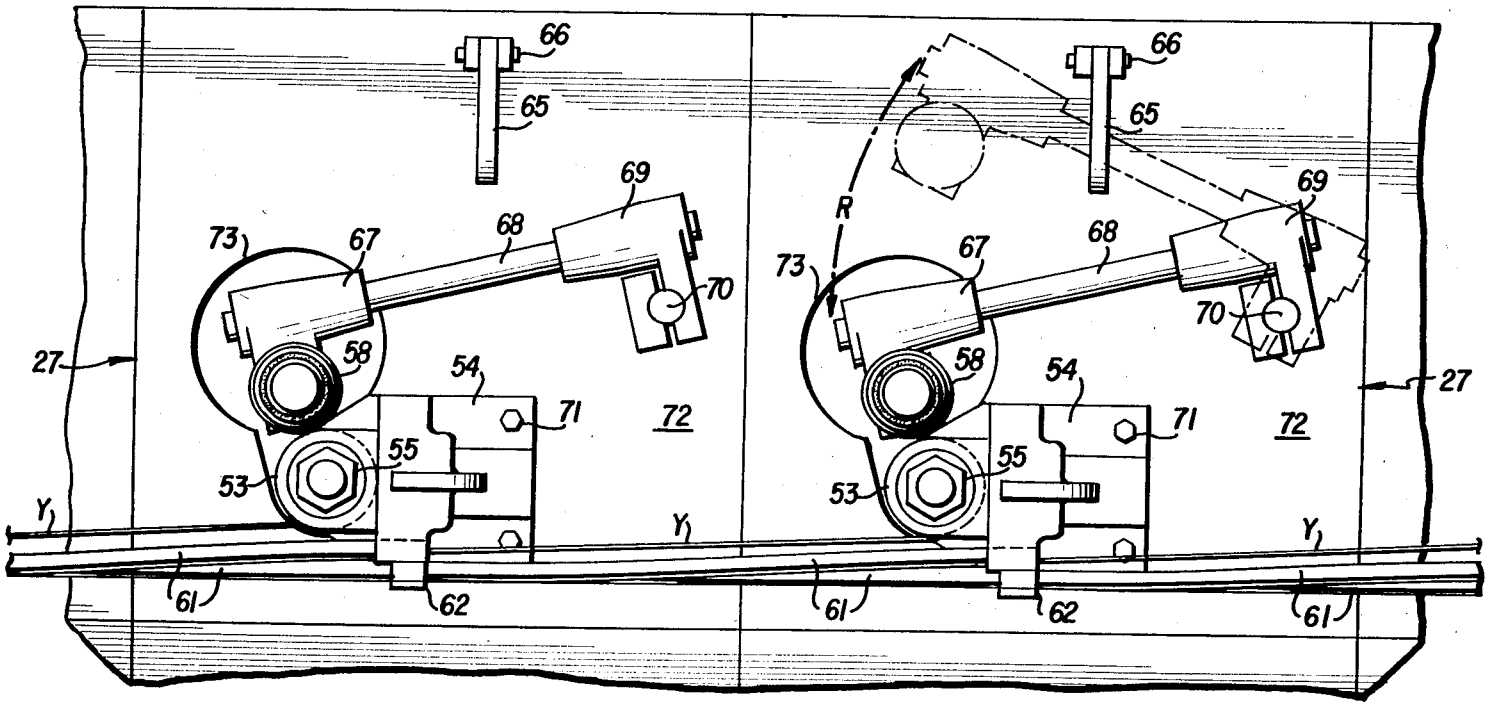
FIG. 7 is a side wall of a pair of winder units taken along line D—D of FIG. 3.

FIGS. 3 and 7 show a tube clamp 62, which supports hollow tubes 61 and is positioned beneath cam support 54. Strands of yarn travel through tubes 61 to downstream winding units, as shown in FIG. 7.

FIG. 7 is an enlarged side view of the external portions of the pair of winding units 27, shown in FIG. 2, which is taken along line D—D of FIG. 3. Spindle 58 is mounted onto lever base 67 which is attached to lever base 69 by lever arm 68. Lever base 67 can be pivoted around pivot point 70 as shown by arc R. Each winding unit 27 is provided with catch means 65 which pivots around pivot point 66. Catch means 65 holds spindle 58 out of contact with cam roller 53 when no yarn is being wound on this spindle, as shown by the dotted lines in FIG. 7. When spindle 58 is used to wind yarn, catch means 65 is pivoted around pivot point 66 so that spindle 58 is released and drops to a position adjacent to cam roller 53 and in alignment with a circular hole 73, which is simply an access hole through which the air gap 48 can be readily measured. See the dashed-line (disengaged) position of the spindle 58, as shown at the right hand side of FIG. 7.

In operation, one or more spools of yarn are unrolled in creel 1 and conveyed to heat setting unit 8 via three-roller stand 2, leaser 4, and pull roller stand 6. The strands of yarn Y are laid across the width of conveyor belt 9 which moves the yarn through heat setting unit 8 and cooling section 10. The strands of yarn are then removed from the conveyor belt and transferred to bin 21 by way of yarn take-off guide unit 11, roller stands 13 and 16, folder 18, and optionally, finishing trough 15. The yarn, which is accumulated in bin 21, is then conveyed through guide tube 22, head roller stand 23, eye board 25, and tubes 61 to opener 26.

Each thread of yarn travels through a tube 61 until it reaches its respective winding unit 27. Yarn is then wound onto the spool 57 disposed on spindle 58 by cam roller 53 upon which spool 57 rides. Yarn is wound evenly along the length of spool 57 by virtue of the fact that it rides in the helical groove path 56 of cam roller 53. Alternatively, cam roller 53 could be designed to oscillate a follower which in turn tracks the yarn. Cam roller 36 always rotates at a constant speed. However, the torque imparted to cam roller 53 can be adjusted to wind different types of thread onto different size spools at a desired tension. To adjust the torque applied to cam roller 53, it is merely necessary to adjust the air gap 48 between drive plates 46 and 50. Drive plate 50 can be moved towards or away from drive plate 46 by respectively tightening or loosening nut 55 on the threaded end of shaft 52 which couples cam roller 53 and drive plate 50. It will of course be understood that the resulting displacement of the grooved cam roller 53, due to changing the width of the air gap 48, is so relatively slight compared to the length of the cam roller 53 itself, that the proper winding of the yarn on the spool 57 carried by the spindle 58 is not in any way interfered with. By increasing the size of air gap 48, the magnetic flux between the drive plates of eddy coupling unit 45 is reduced as is the magnitude of the torque which cam roller 36 imparts to cam roller 53. When the size of air gap 48 is reduced, the magnetic flux density between the plates of the eddy coupling unit is increased as is the torque which cam roller 36 imparts to cam roller 53. Since cam roller 53 has a fixed diameter, adjusting the applied torque likewise adjusts the tension with which yarn is wound. It is therefore apparent that by adjusting the size of air gap 48, the tension with which yarn is wound onto spool 57 can be adjusted to wind different types of yarn onto different size spools.

FIG. 3 shows that each cam roller 36 drives a pair of cam rollers 53 and spools 57. Since each of these cam rollers and spools has its own eddy current coupling unit 45, shaft 52, and nut 55, the torque imparted to each of these cam rollers 53 can be individually adjusted so that each cam roller 53 can be used to wind different types of yarn or to turn different size spools.

The use of eddy coupling unit 45 imparts significant benefits to the winding units of the present invention. Since no mechanical connection is required, there are no friction or wear problems. As a result, the individual winding units of opener 26 are able to operate for long periods without being shut down for repairs.

It is therefore apparent that the apparatus of the present invention performs an improved process of heat setting and winding large quantities of yarn having different lengths and made of different materials.

Although the invention has been described in detail for the purpose of illustration, it is understood that such detail is solely for that purpose and that variations can be made therein by those skilled in the art without departing from the spirit and scope of the invention, except as limited by the claims.

I claim:

1. An apparatus for winding a thread of yarn onto a spool comprising:

a spindle adapted to receive a spool;

a grooved cam roller positioned to rotate said spool received by said spindle and wind yarn on said spool;

a rotatable drive means to rotate said grooved cam roller; and means for coupling said drive means to said grooved cam roller comprising an eddy current coupling unit arranged so that the rotation of said drive means induces a magnetic flux and causes said grooved cam roller to turn thereby rotating said spool and winding yarn on said spool;

said eddy current coupling unit comprising a first drive plate with a layer of current carrying material; and a second drive plate with a layer of magnetic material, said drive plates being arranged so that they face each other and define an air gap between said layer of current carrying material and said layer of magnetic material;

said current carrying material comprising copper or aluminum;

said means for coupling further comprising a first shaft connecting said first drive plate and said rotatable drive means, and a second shaft upon which is mounted said second drive plate and said grooved cam roller; and means for moving said second drive plate, said second shaft and said grooved cam roller toward or away from said first drive plate so that the size of said air gap can be varied.

2. An apparatus for winding a thread of yarn onto a spool, according to claim 1, further comprising:

a cam support for housing said grooved cam roller, wherein said grooved cam roller is mounted on said second shaft, the end of said second shaft opposite the portion attached to said second drive plate passes through an opening in said cam support, and said means for moving said second drive plate said second shaft and said grooved cam roller comprises a nut attached to threads on the end of said second shaft.

3. An apparatus for winding a thread of yarn onto a spool, according to claim 1, wherein said rotatable drive means comprises:

a cam roller;

belt means engageable with said cam roller so that when said belt means moves, said cam roller rotates; and means to move said belt.

4. An apparatus for winding a thread of yarn onto a spool, according to claim 1, wherein said spool rides on said grooved cam roller so that the rotation of said grooved cam roller causes the spool to turn due to friction.

5. An apparatus for winding a thread of yarn onto a spool, according to claim 4, wherein said grooved cam roller has a helical groove whereby yarn riding in the groove is evenly wound along the length of the spool.

6. An apparatus for winding a thread of yarn onto a spool, according to claim 4, further comprising:

a catch means engageable with said spindle so that said spindle is held above said grooved cam roller when yarn is not being wound on the spool mounted on said spindle.

7. An apparatus for winding each of a plurality of yarn threads onto separate spools comprising:

an opener having a plurality of thread winder units each winding a single thread, wherein each of said thread winder units comprises:

a spindle adapted to receive a spool;

a grooved cam roller positioned to rotate said spool received by said spindle and wind yarn on said spool;

a rotatable drive means to rotate said grooved cam roller; and means for coupling said drive means to said grooved cam roller comprising an eddy current coupling unit arranged so that the rotation of said drive means induces a magnetic flux and causes said grooved cam roller to turn thereby rotating said spool and winding yarn on said spool;

said eddy current coupling unit comprising a first drive plate with a layer of current carrying material; and a second drive plate with a layer of magnetic material, said drive plates being arranged so that they face each other and define an air gap between said layer of current carrying material and said layer of magnetic material;

said current carrying material comprising copper or aluminum;

said means for coupling further comprising a first shaft connecting said first drive plate and said rotatable drive means, and a second shaft upon which is mounted said second drive plate and said grooved cam roller; and means for moving said second drive plate, said second shaft and said grooved cam roller toward or away from said first drive plate so that the size of said air gap can be varied.

8. An apparatus for winding each of a plurality of yarn threads onto separate spools, according to claim 7, further comprising:

a cam support for housing said grooved cam roller, wherein said grooved cam roller is mounted on said second shaft, the end of said second shaft opposite the portion attached to said second drive plate passes through an opening in said cam support, and said means for moving said second drive plate, said second shaft and said grooved cam roller comprises a nut attached to threads on the end of said second shaft.

9. An apparatus for winding each of a plurality of yarn threads onto separate spools, according to claim 7, wherein said rotatable drive means comprises:

a cam roller;

belt means engagable with said cam roller so that when said belt means moves, said cam roller rotates; and belt drive means.

10. An apparatus for winding each of a plurality of yarn threads onto separate spools, according to claim 9, wherein each cam roller induces the rotation of a pair of said grooved cam rollers located on opposite sides of said cam roller.

11. An apparatus for winding each of a plurality of yarn threads onto separate spools, according to claim 10, wherein said belt means moves horizontally and powers a plurality of cam rollers along its horizontal path of movement.

12. An apparatus for winding each of a plurality of yarn threads onto separate spools, according to claim 11, wherein said opener is provided with a plurality of horizontally moving belt means positioned vertically with respect to each other and each powering vertically spaced winding units, said belt drive means powering all of said belt means.

13. An apparatus for winding each of a plurality of yarn threads onto separate spools, according to claim 11, further comprising a plurality of hollow tubes beneath said winder units, wherein yarn passes through said hollow tubes and is wound onto the spools of downstream winding units.

* * * * *